US008733739B2

(12) United States Patent
Mauthner et al.

(10) Patent No.: US 8,733,739 B2
(45) Date of Patent: May 27, 2014

(54) DEVICE THAT INTEGRATES AN ASCENDER WITH A PULLEY BLOCK

(76) Inventors: Kirk Martin Mauthner, Wilmer (CA); Rocke P. Thompson, Bountiful, UT (US)

( * ) Notice: Subject to any disclaimer, the term of this patent is extended or adjusted under 35 U.S.C. 154(b) by 385 days.

(21) Appl. No.: 13/065,322

(22) Filed: Mar. 21, 2011

(65) Prior Publication Data

US 2012/0241700 A1 Sep. 27, 2012

(51) Int. Cl.
*B66D 3/04* (2006.01)

(52) U.S. Cl.
USPC ..... 254/391; 254/407; 254/408

(58) Field of Classification Search
USPC ..... 254/390, 391, 405, 406, 407, 408
See application file for complete search history.

(56) References Cited

U.S. PATENT DOCUMENTS

| | | | | | |
|---|---|---|---|---|---|
| 723,231 | A * | 3/1903 | Benedict | 254/391 |
| 1,167,295 | A * | 1/1916 | Hall | 24/134 KB |
| 1,359,051 | A * | 11/1920 | Goetz | 24/134 R |
| 1,432,096 | A * | 10/1922 | Behie | 254/226 |
| 1,732,084 | A * | 10/1929 | Dalton | 254/406 |
| 1,764,512 | A * | 6/1930 | Hume | 254/391 |
| 1,798,844 | A * | 3/1931 | Johansson | 254/391 |
| 2,343,086 | A * | 2/1944 | Schultz | 254/391 |
| 2,623,732 | A * | 12/1952 | Morgan | 254/391 |
| 3,662,992 | A * | 5/1972 | Vittert | 254/391 |
| 4,097,023 | A * | 6/1978 | Muller | 254/391 |
| 4,521,000 | A * | 6/1985 | Dodge, Jr. | 254/391 |
| 5,054,577 | A * | 10/1991 | Petzl et al. | 182/5 |
| 5,368,281 | A * | 11/1994 | Skyba | 254/391 |
| 5,597,052 | A * | 1/1997 | Rogleja | 188/65.5 |
| 5,664,640 | A * | 9/1997 | Smith | 182/5 |
| 5,799,753 | A * | 9/1998 | Peltier | 182/234 |
| 5,845,894 | A * | 12/1998 | Petzl et al. | 254/391 |
| 5,868,380 | A * | 2/1999 | Allen | 254/391 |
| 5,927,438 | A * | 7/1999 | Ostrobrod | 182/241 |
| 6,182,946 | B1 * | 2/2001 | Rutherford | 254/391 |
| 6,902,031 | B2 * | 6/2005 | Ador | 182/5 |
| 7,419,138 | B1 * | 9/2008 | Mauthner | 254/394 |
| 7,467,783 | B2 * | 12/2008 | Rawdon | 254/391 |
| 7,537,199 | B1 * | 5/2009 | Anderson | 254/411 |
| 7,658,264 | B2 * | 2/2010 | Mauthner | 182/5 |
| 7,673,851 | B2 * | 3/2010 | Lange | 254/409 |
| 2002/0017428 | A1 * | 2/2002 | Mauthner | 182/5 |
| 2002/0134974 | A1 * | 9/2002 | Fujiwara et al. | 254/391 |
| 2003/0071253 | A1 * | 4/2003 | Lob et al. | 254/391 |
| 2004/0201005 | A1 * | 10/2004 | Stone | 254/391 |
| 2005/0173687 | A1 * | 8/2005 | Smith | 254/391 |
| 2006/0207829 | A1 * | 9/2006 | Mauthner | 182/5 |
| 2008/0203371 | A1 * | 8/2008 | Mauthner | 254/391 |
| 2009/0072209 | A1 * | 3/2009 | Smith | 254/391 |

* cited by examiner

*Primary Examiner* — Emmanuel M Marcelo
*Assistant Examiner* — Michael Gallion

(57) ABSTRACT

A device that integrates an ascender with a pulley block consisting of two side plates pivotally connected to one another and selectively opened or closed, for loading a rope into a rope channel defined therebetween. Affixed adjacent the rope channel is a selectively activated rope clamp, to hold or release a rope. A sheave adapted to freewheel on an axle, is positioned offset the rope channel, and is used for mechanical advantage rigging when ascending or rescue. Also, a link connection is located at or near the sheave and is used for the attachment of a foot loop or other connection for assisting in ascending on a rope.

2 Claims, 8 Drawing Sheets

DEVICE THAT INTEGRATES AN ASCENDER WITH A PULLEY BLOCK

FIELD OF INVENTION

This invention relates generally to a rope ascending device and more particularly, to a versatile rope clamp ascender with an integrated pulley block.

BACKGROUND

Rope ascenders and pulleys as used for rock climbing, rescuing or lifting purposes, are generally well known. An ascender and a pulley block combination is also well known, whereas the present invention offers unique properties and arrangements, the advantages of which are listed below in the Summary of the Invention.

Past inventions that include locking sheaves and that incorporate some of the basics of the present invention are numerous. Inventors are aware of U.S. Pat. No. 7,658,264 issued to Mauthner, Feb. 9, 2010 entitled, Combination descender, pulley and force limiting rope brake; U.S. Pat. No. 7,168,687 issued to Thompson, Jan. 30, 2007 entitled, Snatch block, snatch block assembly and method of use; U.S. Pat. No. 6,601,829 issued to Graham, Aug. 5, 2003 entitled, Pulley system with gripping block and tackle for load handling; U.S. Pat. No. 5,845,894 issued to Petzl, et al. Dec. 8, 1998 entitled, Pulley with a pivoting flange and built-in jammer; U.S. Pat. No. 5,664,640 issued to Smith Sep. 9, 1997 entitled Ascending cam and U.S. Pat. No. 723,231 issued to Benedict Mar. 24, 1903 entitled, Pulley Block; all of which are listed here for reference purpose only.

SUMMARY OF THE INVENTION

The unique design of this rope ascender with integrated pulley block, allows it to be used as either a conventional rope ascender to raise oneself by utilizing the rope clamp alone, or with a foot loop attached and it can be used in a 3 to 1 mechanical advantage pulley block configuration such as when lifting oneself, and or when an assistant helps raise a person or a load.

The device can also be used to raise a person in a rescue without the help of the person being raised, as with the rescue of an incapacitated climber.

It should be mentioned that the device can be used in various other mechanical advantage lifting configurations.

The device comprises a front plate and a rear plate, where the front plate and the rear plate are arranged opposing one another and are pivotally connected to one another. Between the front plate and the rear plate a rope channel is defined, offset the rope channel, and between the front and rear plates is a pulley sheave. The pulley sheave is rotationally mounted to an axle so as to freewheel within the front and rear plates. The front plate and the rear plate are pivotally opened to load a rope in the rope channel as well as onto the pulley sheave, as may be required. The front plate and the rear plate are interlocked when closed by means of a fastener and a clasp. The clasp mounted on the rear plate overlaps a spline on the edge of the front plate, thereby increasing the rigidity of the front and rear plates when closed. Adjacent the rope channel also between the front plate and the rear plate is a rope clamp, where the rope clamps holds onto a rope threaded via a ribbed rope contact surface through the rope channel when ascending the rope. The pulley sheave axle is centrally open therethrough to allow the attachment of a link, to attach a foot loop or other attachment. The rope channel having a clamping wall rigidly affixed to the first plate as to remain stationary relative to the first plate; wherein the rope channel clamping wall divides the rope clamp from the pulley sheave. In further, wherein the selectively activated rope clamp is a rotational cam. The rotational cam having an affixed lever located between the first and second plates. The lever further having a first and a second mounting surface facing the first and second plates.

A principal object of the invention is to provide a device that is versatile, enabling various ascending and rescue uses, by making possible various mechanical riggings.

Another object of the invention is to provide an apparatus that can be quickly and easily attached to a rope and easily enabled into use.

Another object of the present invention is to provide an improved device that is compact in size and easy to carry.

A further object is to provide a device that is capable of attaching a link for a foot loop or for an additional pulley block.

Yet a further object is to provide a device that is durable in use and yet cost effective to market.

The present invention has other objects and features of advantage, which will become apparent from and are set forth in more detail in the description and the accompanying drawings.

BRIEF DESCRIPTION OF DRAWINGS

Advantages of the present invention will become more fully appreciated as the same becomes better understood when considered in conjunction with the following detailed description of an illustrative embodiment and accompanying drawings, in which like reference characters designate the same or similar parts throughout the several views, wherein.

DETAILED DESCRIPTION OF THE PREFERRED EMBODIMENTS

Figure 1:
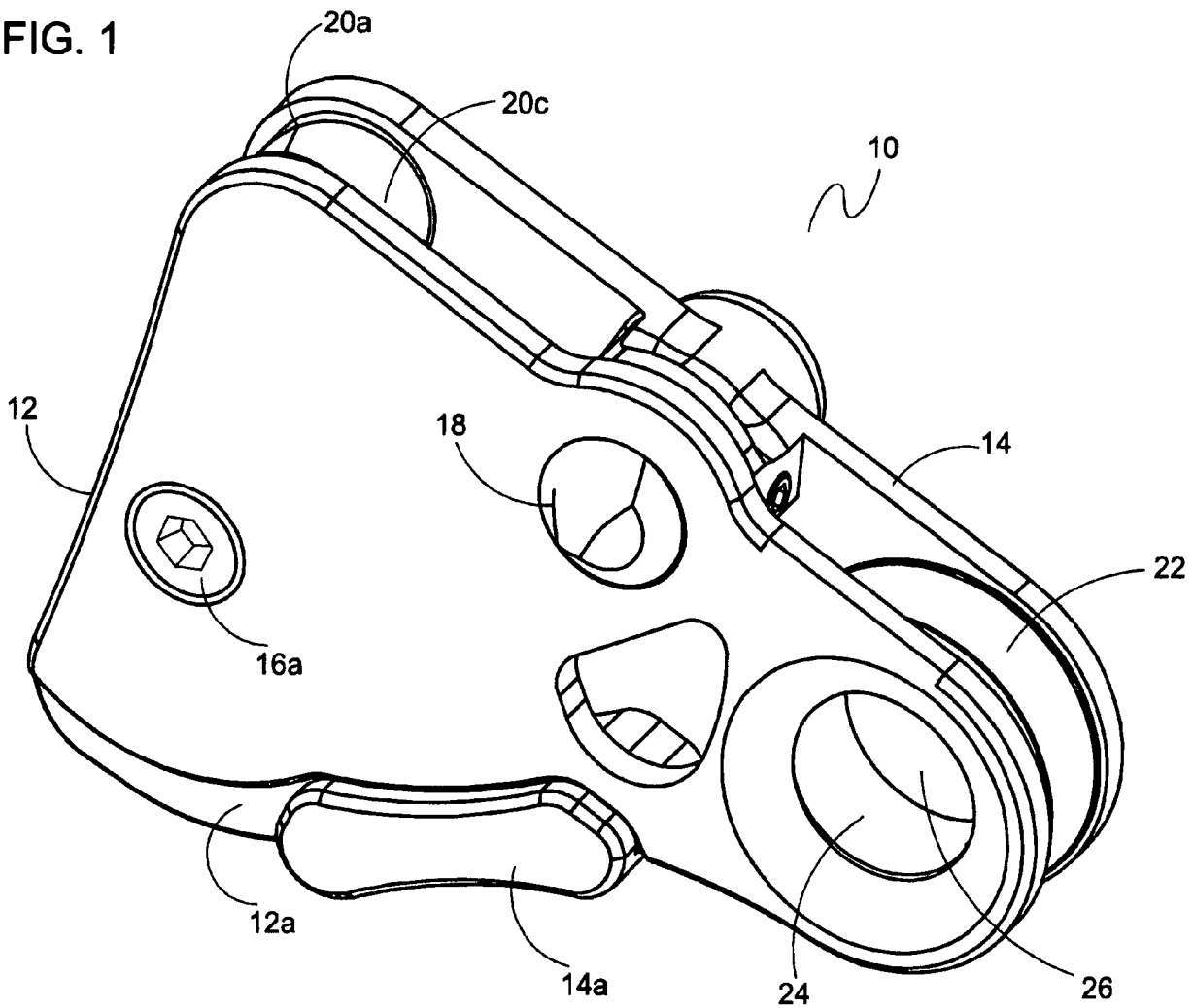
FIG. 1 is a front perspective view of a device that integrates an ascender with a pulley block according to the embodiment of the present invention.

Referring to FIG. 1 where a front perspective view shows the device that integrates an ascender with a pulley block, which is generally referred to here as device 10. Device 10 includes a front plate 12 and a rear plate 14. Front plate 12 and rear plate 14 are arranged opposing one another and are pivotally connected to one another by a pivot pin 16, and are secured together on pivot pin 16 by a pivot pin fastener 16*a*. Front plate 12 and rear plate 14 are interlocked when closed by means of snap fastener 18. Also, a clasp 14*a* and a clasp spline 12*a* interlock to increase rigidity of device 10 when front plate 12 and the rear plate 14 are interlocked in the closed position. In between the front plate 12 and the rear plate 14 and adjacent the rope channel 14*a* is a rope clamp 20. Rope clamp 20 has a lever 20*a*, a cam 20*b*, cam lever groove 20*c* and a cam pivot point 20*d*.

A freewheeling sheave 22 is mounted on a hollow spindle or axle 24, axle 24 is attached to rear plate 14, where axle 24 stretches between rear plate 14 up to front plate 12. Hollow opening in axle 24, axle opening 26, allows the connection of a carabiner (not shown) or other link through axle opening 26.

Figure 2:
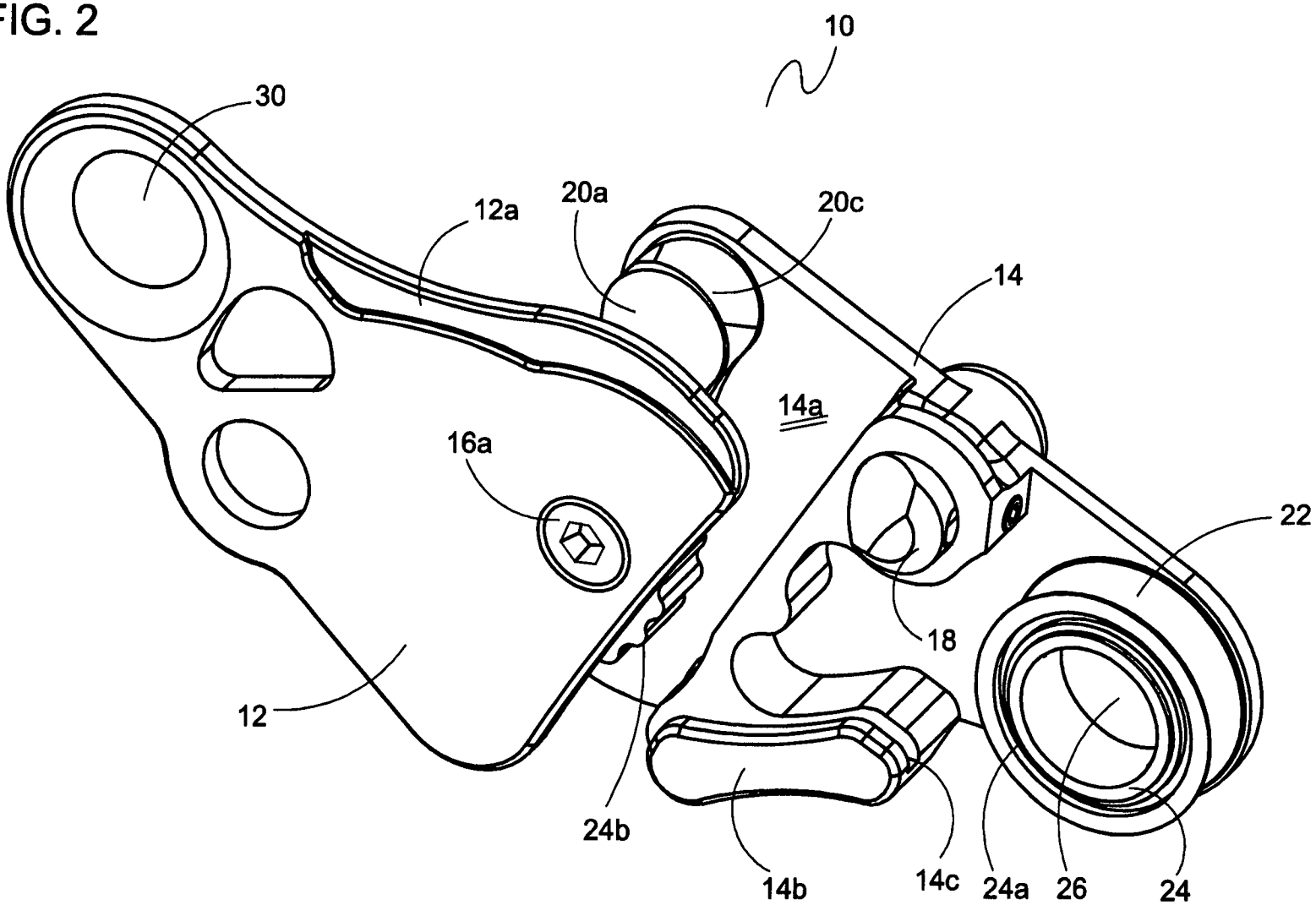
FIG. 2 is a front perspective view of a device that integrates an ascender with a pulley block according to the embodiment of the present invention, where the device is in the open, or rope loading position.

As in FIG. 2 a front perspective view of the ascender device showing the device 10 in the open or rope loading position. Front plate 12 and rear plate 14 are pivotally opened to load a rope (not shown) in rope channel 14*a* or onto sheave 22. As clamp 20 pivots at pivot point 20*d* on pivot pin 16, clamp lever groove 20*c* on lever 20 interacts with rope (not shown). Front plate lip 12*a* interacts with slot 14*c* of clasp 14*a* as front plate 12 and rear plate 14 overlap one another by clasp 14*a* which is positioned adjacent pivot 16. Sheave 22 is held to axle 24 by a retainer 24*a*.

Figure 3:
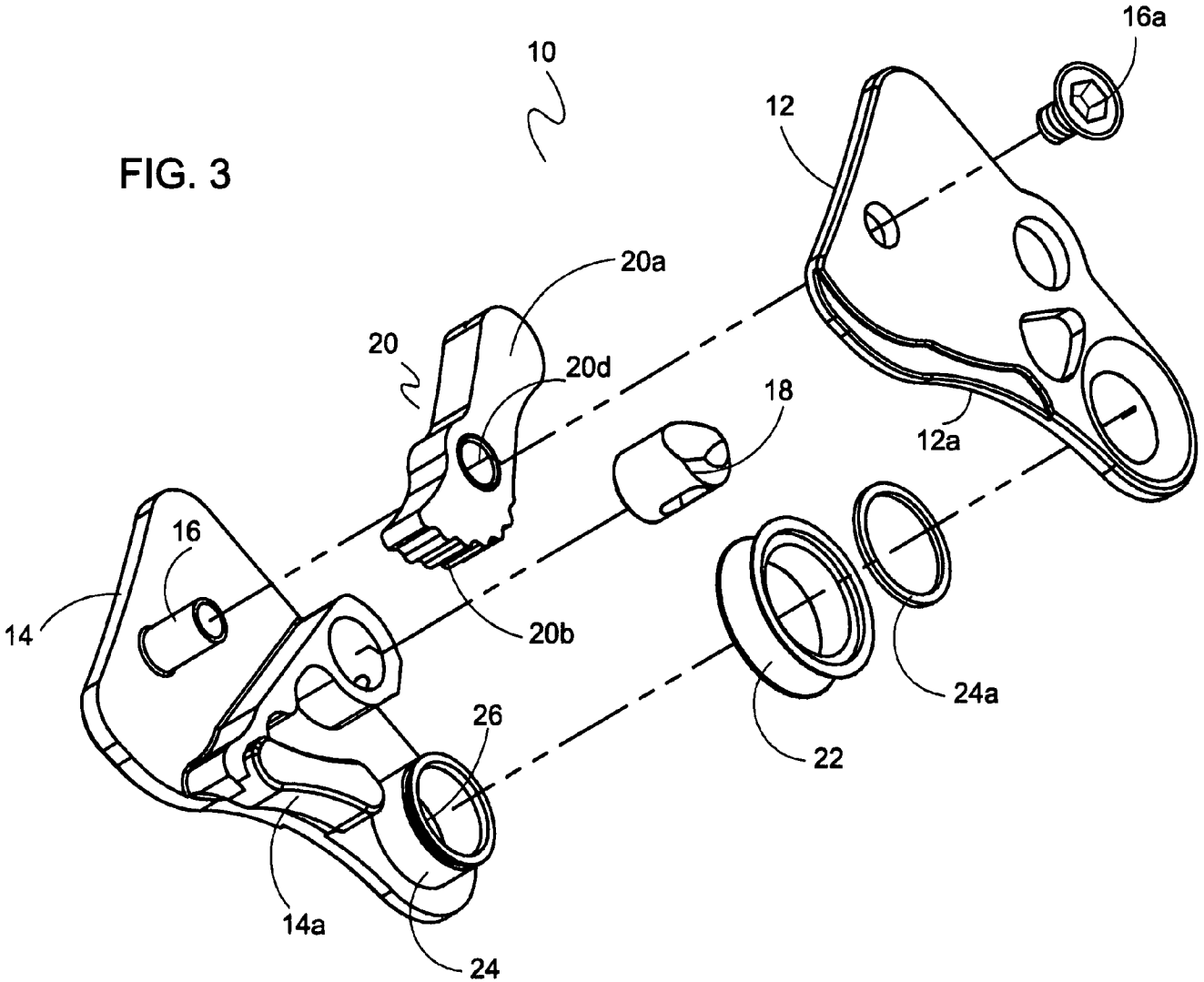
FIG. 3 is an exploded rear perspective view of a device that integrates an ascender with a pulley block according to the embodiment of the present invention.
Figure 4:
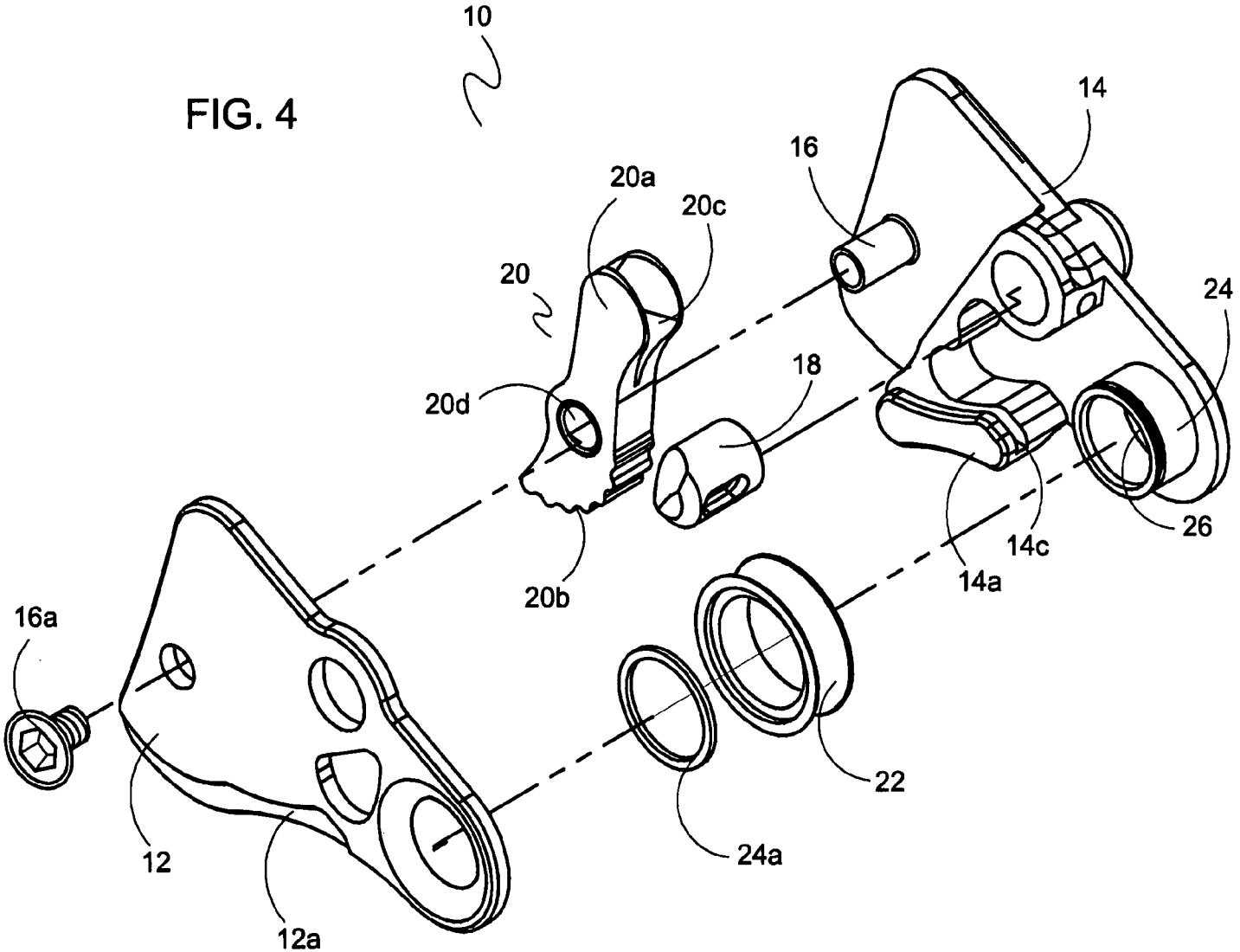
FIG. 4 is an exploded front perspective view of a device that integrates an ascender with a pulley block according to the embodiment of the present invention.
Figure 5:
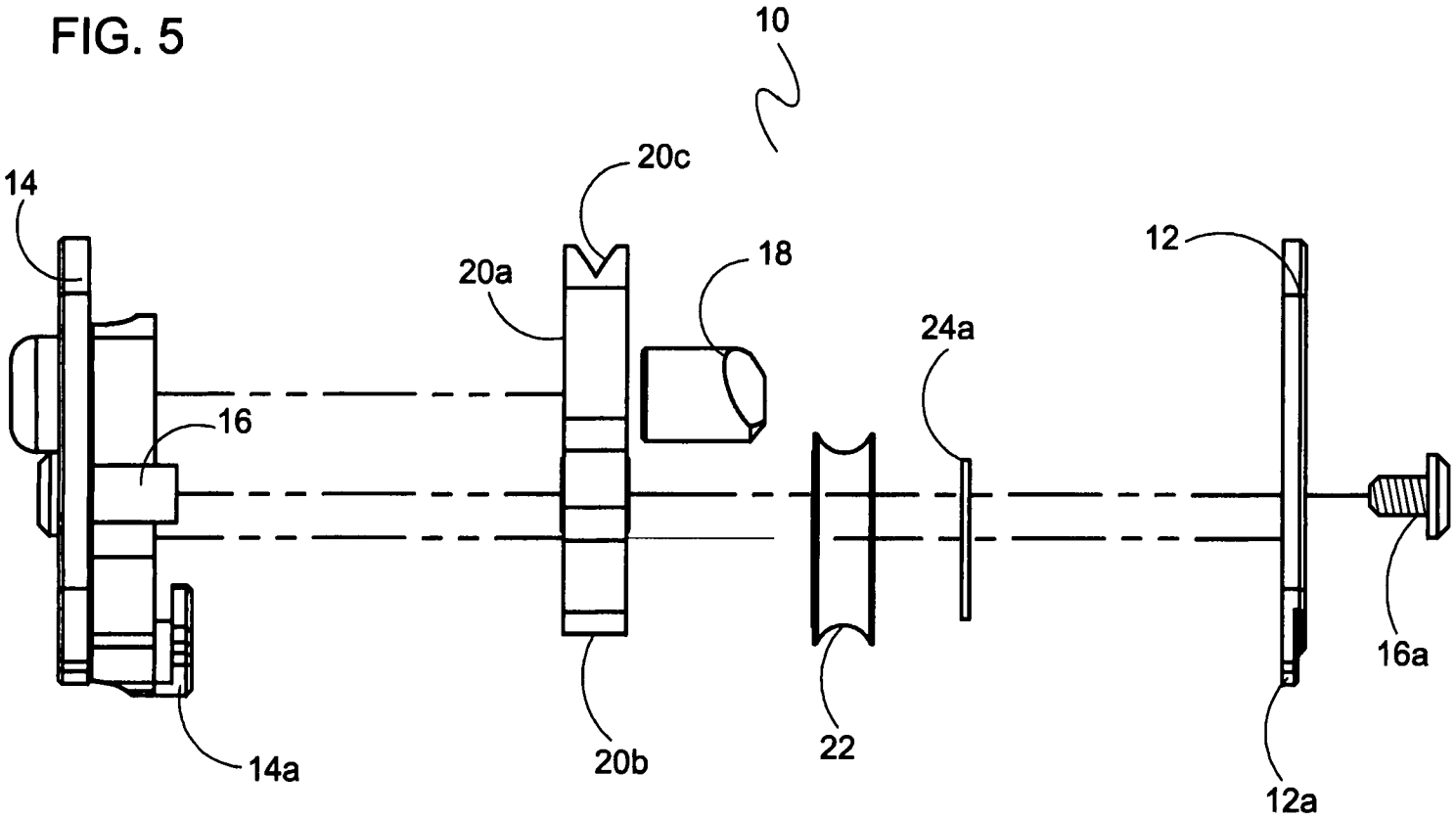
FIG. 5 is an exploded rear elevational view of a device that integrates an ascender with a pulley block according to the embodiment of the present invention.
Figure 6:
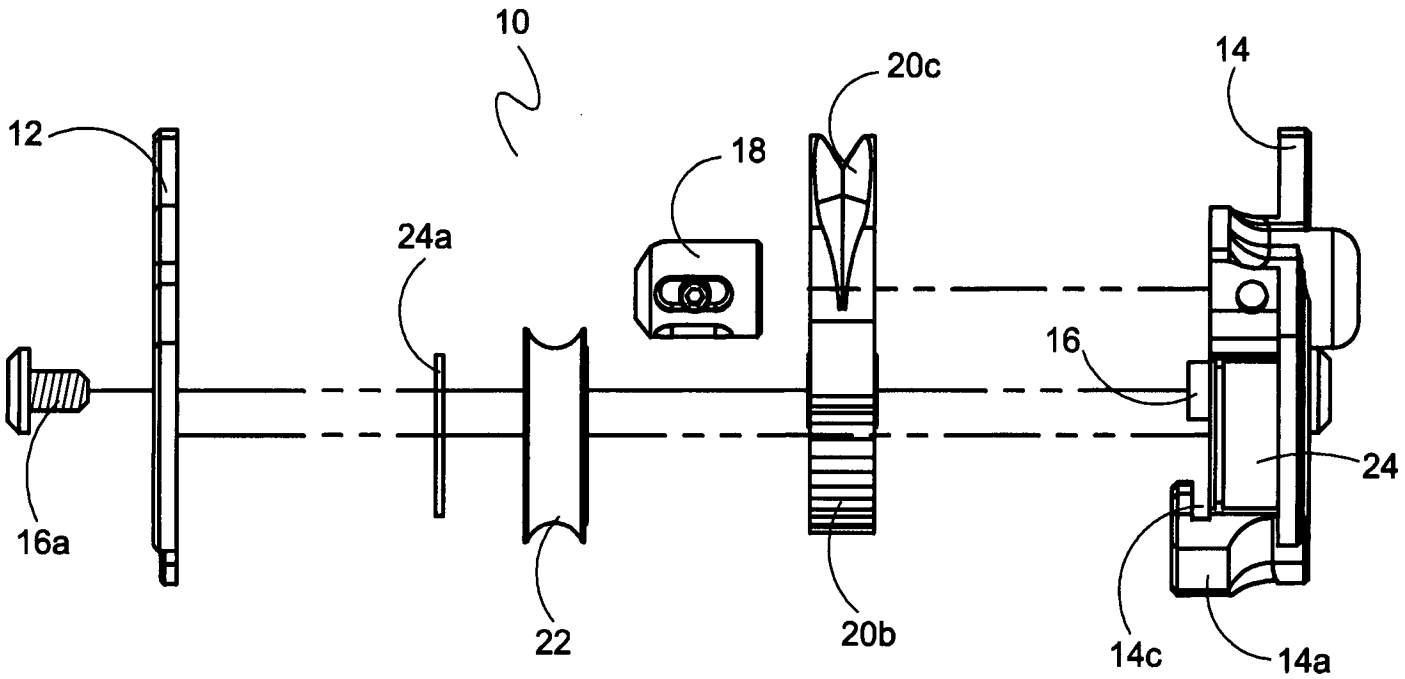
FIG. 6 is an exploded front elevational view of a device that integrates an ascender with a pulley block according to the embodiment of the present invention.

The following exploded views are included to better reveal the assembly of device 10. FIG. 3 shows an exploded rear perspective view of device 10. FIG. 4 shows an exploded front perspective view of device 10. FIG. 5 shows an exploded rear elevation view of device 10. FIG. 6 shows an exploded front elevational view of device 10.

Figure 7:
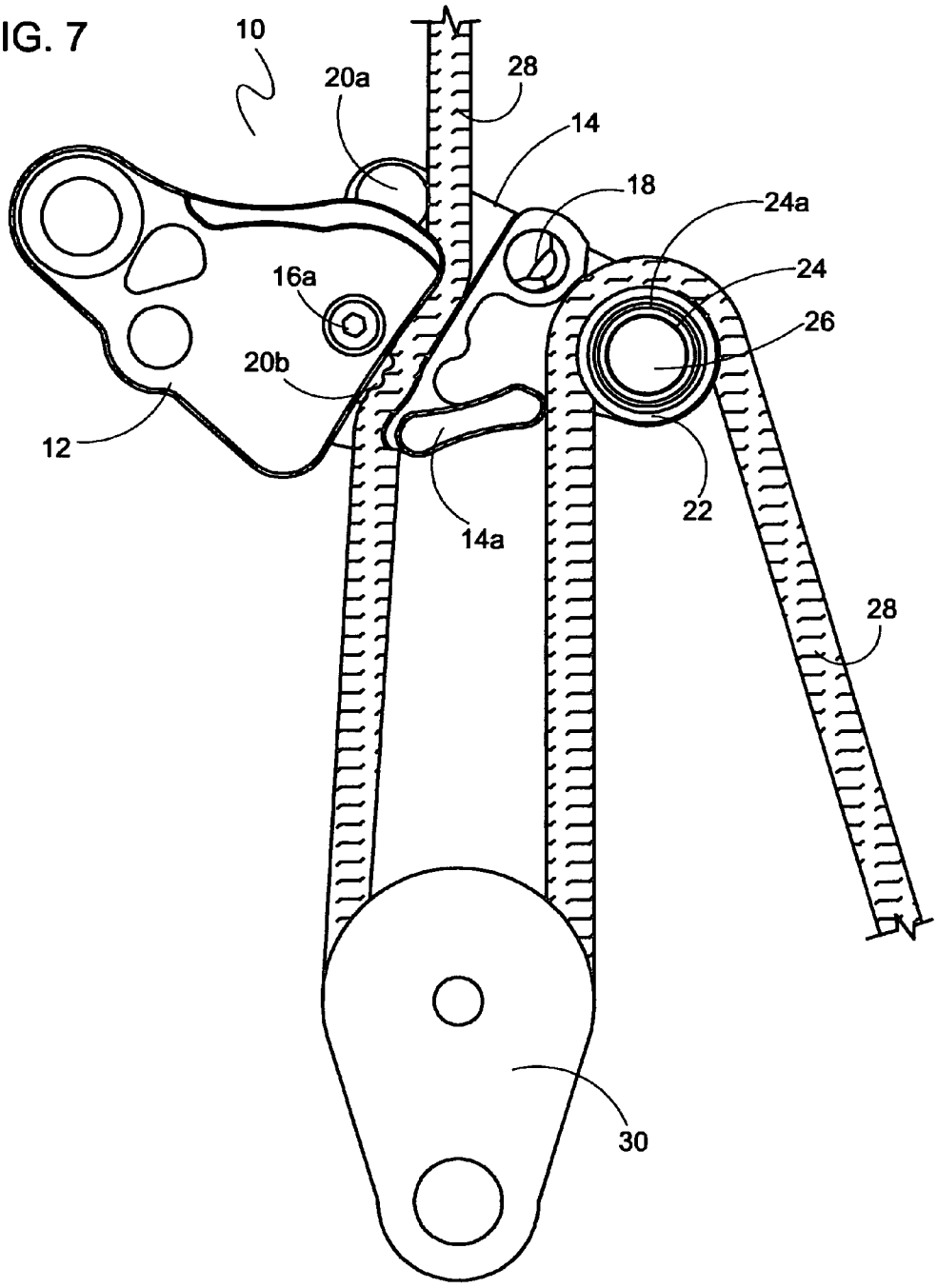
FIG. 7 is a front elevational view of a device that integrates an ascender with a pulley block according to the embodiment of the present invention, where the device is in the open, or rope loading position with a rope loaded in the rope channel as well as the onto the pulley sheave.

FIG. 7 shows device 10 in a front elevational view, with front plate 12 swung open, where a rope 28 is loaded into rope channel 14*a*, onto sheave 22 and down through an optional pulley block 30. This configuration shows how device 10 would be used in a three-to-one mechanical advantage rigging.

Figure 8:
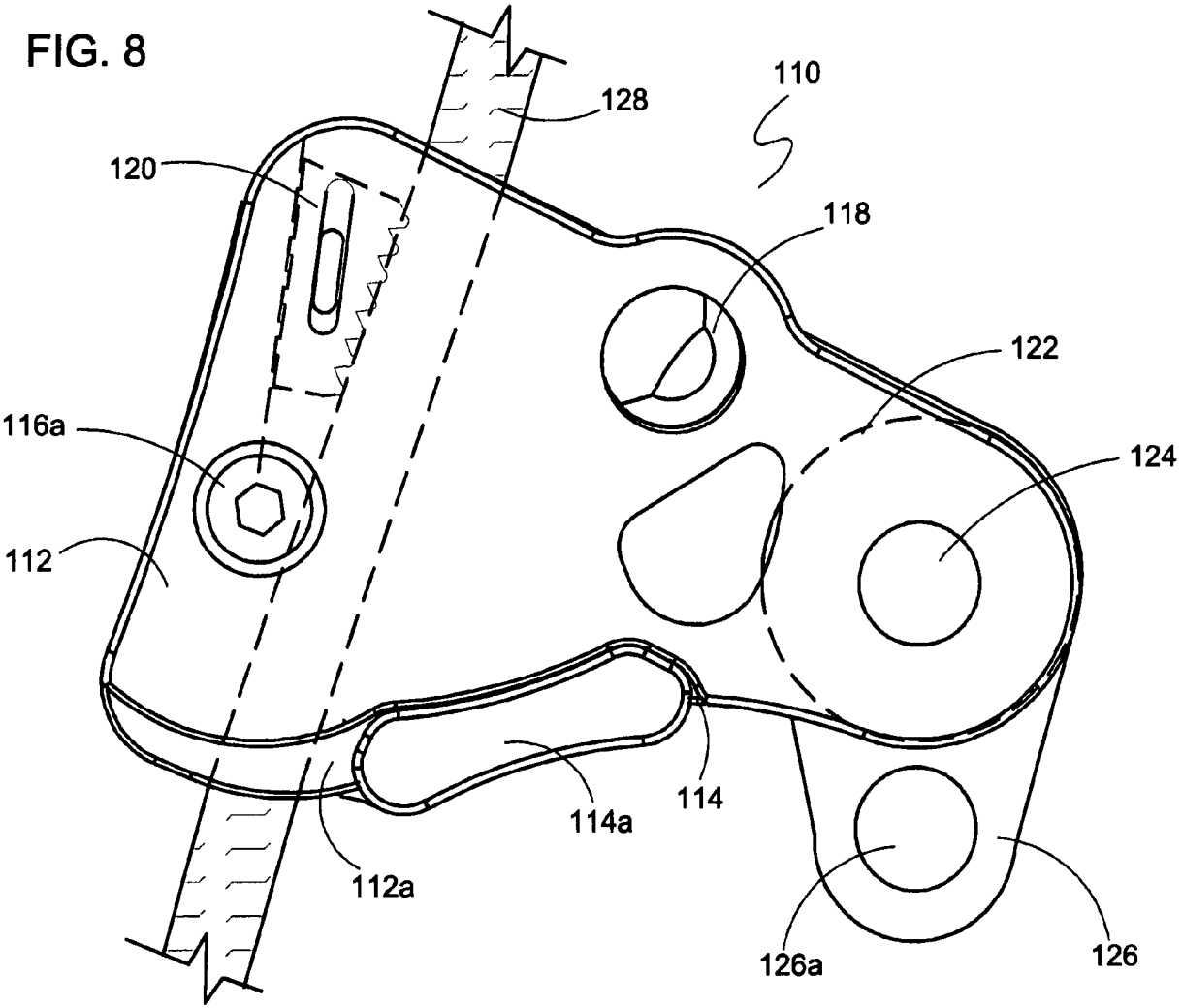
FIG. 8 is a front elevational view of a device that integrates an ascender with a pulley block according to an alternate embodiment of the present invention.

FIG. 8 is a front elevational view of a device that integrates an ascender with a pulley block according to an alternate embodiment of the present invention, which is generally referred to here as device 110. Device 110 is shown in the closed position, where a front plate 112 is in the forefront of rear plate 114, which is not fully visible. Front plate 112 is shown closed and interlocked to the rear plate 114 by clasp 114*a*, which overlaps clasp spline 112*a*. Also, front plate 112 and rear plate 114 are interlocked together by snap fastener 118 and pivot pin fastener 116*a*. A sheave 122 is shown under front plate 112 as a hidden or dashed circle and is mounted between front plate 112 and rear plate 114 on an axle 124. A slidable rope clamp 120 is shown under front plate 112 with hidden lines, and is mounted between front plate 112 and rear plate 114. A link attachment flange 126, with opening 126*a* is affixed to device 110 below sheave 122. A rope 128 is shown going through device 110.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. While the invention has been described in its preferred embodiments, it is to be understood that the words which have been used are words of description and not of limitation. Therefore, changes may be made within the appended claims without departing from the true scope of the invention.

It is intended that the scope of the invention be defined by the Claims appended hereto and their equivalents, which should be given their fair and fullest scope.

What is claimed is:

1. In combination a versatile ascender device with a rope clamp and a separated pulley sheave, said device, having a first plate and a second plate pivotally connected and opposing one another, said opposing plates having a first end and a second end, said device comprising: a rope channel defined therebetween said first plate and said second plate at said first end of said opposing plates; said first plate and said second plate selectively and pivotally opened or closed, said first plate and said second plate are interlocked when closed; directly adjacent said rope channel is said rope clamp, said rope channel having a clamping wall rigidly affixed to said first plate, where said rope channel clamping wall divides said rope clamp from said pulley sheave, wherein said clamping wall remains stationary relative the first plate, said rope clamp is selectively activated to hold or release a rope threaded through said rope channel, said pulley sheave located therebetween said first plate and said second plate at said second end of said opposing plates, where said pulley sheave is adapted to freewheel on an axle mounted therebetween said first plate and said second plate, wherein near therethrough center of said pulley sheave axle is an opening to attach a connection link, to connect a foot loop or other connection; and wherein said selectively activated rope clamp is a rotational cam, said rotational cam having an affixed lever, said lever located between said first and said second plates; wherein said lever having a first and a second mounting surface facing said first and said second plates, said rope clamp having a rope contact surface, wherein said lever is a length from its pivot point opposite said rope clamp surface.

2. The device as defined in claim 1, wherein said affixed lever has a scalloped V-shaped lengthwise groove on its outer and upper length, oriented toward said rope channel, for selective manual operation to assist in activation of said rope clamp, by manual operation of said rope clamp onto said rope.

* * * * *